US005230774A

United States Patent [19]

Greer et al.

[11] Patent Number: 5,230,774

[45] Date of Patent: Jul. 27, 1993

[54] SYNERGISTIC PITCH CONTROL PROCESS UTILIZING AMMONIUM ZIRCONIUM AND CATIONIC POLYMERS

[75] Inventors: Carol S. Greer, Lisle; Nancy P. James, Lombard, both of Ill.

[73] Assignee: Nalco Chemical Company, Naperville, Ill.

[21] Appl. No.: 753,549

[22] Filed: Sep. 3, 1991

[51] Int. Cl.[5] ..... D21H 21/02

[52] U.S. Cl. ..... 162/164.3; 162/164.6; 162/168.2; 162/181.2; 162/199; 162/DIG. 4

[58] Field of Search ..... 162/168.2, 164.3, 164.6, 162/181.2, 199, DIG. 4

[56] References Cited

U.S. PATENT DOCUMENTS

| | | | |
|---|---|---|---|
| 3,582,461 | 6/1971 | Lipowski et al. | 162/72 |
| 3,812,055 | 5/1974 | Carstens et al. | 252/313 |
| 3,895,164 | 7/1975 | Carstens et al. | 428/329 |
| 3,896,046 | 7/1975 | Carstens et al. | 252/310 |
| 3,992,249 | 11/1976 | Farley | 162/72 |
| 4,313,790 | 2/1982 | Pelton et al. | 162/163 |
| 4,950,361 | 8/1990 | Bender et al. | 162/199 |

FOREIGN PATENT DOCUMENTS

| | | | |
|---|---|---|---|
| 1150914 | 8/1983 | Canada . | |
| 1194254 | 10/1985 | Canada . | |
| 55-112094 | 9/1980 | Japan | 162/5 |

*Primary Examiner*—Peter Chin

*Attorney, Agent, or Firm*—Robert A. Miller; James J. Drake; Donald G. Epple

[57] ABSTRACT

Pitch control agents comprising a combination of water-soluble zirconium compounds and cationic polymers are described.

Ammonium zirconium carbonate is preferred in combination with poly DADMAC and/or with EPI-DMA polymers.

4 Claims, 3 Drawing Sheets

INHIBITION OF PITCH DEPOSITION
AZC VS polyEPI-DMA-NH3 VS COMBINATIONS
% INHIBITION OF PITCH DEPOSITION VS PRODUCT DOSAGE
A
C
A+C (1:3 RATIO)
A+C (1:1 RATIO)
A+C (3:1 RATIO)
% INHIBITION OF PITCH DEPOSITION
DOSAGE LB/TON ACTIVES BASIS
0.000
0.025
0.050
0.075
0.100
0.125
0.150
0.165
0.169
0.175
0.200
0.203
0.208
0.225
0.250
0.275
0.300
0
10
20
30
40
50
60
70
80
90
100

SYNERGISTIC PITCH CONTROL PROCESS UTILIZING AMMONIUM ZIRCONIUM AND CATIONIC POLYMERS

BACKGROUND OF THE INVENTION

This invention relates to methods for using synergistic blends, water soluble, zirconium compounds, and cationic polymers to prevent pitch deposition in pulping and papermaking processes. By practicing the methods of this invention, those operating a pulping and papermaking process can disperse naturally occurring pitches, thereby preventing the deposition of pitch on machinery used in the pulping and papermaking process and simultaneously preventing the formation of visible pitch particles in the final paper products.

Also, by practicing this invention, a papermaker may also remove existing pitch deposits from machinery used in the pulping and papermaking processes.

RELATED ART

Problems caused by pitch build-up on pulp and papermaking machinery and formation of pitch globules in the final paper, thereby requiring repulping and recycle, cost the pulp and paper industry considerable money both in terms of dollars and in terms of time and lost production. Pitch is considered to be a resin based deposit of varying natures coming from widely varying compositions originating in extractive fractions of wood. These extractive fractions are normally complex mixtures of substances, sometimes soluble in cold water, but most likely soluble in alcohol, benzene, ether, and acetone and making up about 3 to about 10 percent of the weight of wood. These extractive fractions of wood containing the pitch normally contains low molecular weight cabohydrates, turpenes, aromatic and aliphatic acids, fatty alcohols, tannins, color bodies and other colored substances, resins and resin esters, proteins, phlobaphenes, lignins, alkaloids, and some soluble lignins.

Components of pitch can also include organic resinous and tarry materials made up of the above ingredients, as well as complex organic materials derived from wood processing.

Pitch is a major problem in pulp and papermaking because it agglomerates into visible globules containing not only pitch materials but any occluded materials and collects not only in the final paper product but also plates out and collects on machinery surfaces used in the pulp and papermaking processes such surfaces including but not limited to screens, filters, refining equipment, pulp washers, the paper machine itself, and the like. The presence of these pitch deposits reduces pulp brightness and brightness stability and generally causes a poor quality paper surface and paper appearance.

Pitch may vary in its composition depending upon the time of year of tree harvest and pulping, the type of wood being used, the type of pulping process being used, a type of tree from which the wood is derived, and the like. Pitch deposited from softwood Kraft mill slurries has a relatively larger abietic acid to fatty acid/ester ratio than the pitch found in hardwood Kraft mills. Pitch deposits observed in sulfite mills appear to be more severe than in other types of pulping processes.

Pitch problems exist not only in Kraft mills operating on softwood but also in Kraft mills operating on hardwood, in sulfite mills as above, and also occur in mechanical pulp mills, including groundwood mills, TMP, CTMP, and semi-chemical pulping processes, and the like. Pitch comprises fatty acid esters, fatty acids, resins, resin esters, and other ingredients as listed above.

A number of approaches have been attempted to solve the difficulties of pitch deposits in the manufacture of pulp and paper. Such attempts include the use of polyquaternary ammonium polymers, as is found in U.S. Pat. No. 3,582,461, Lipowski, et. al., and in U.S. Pat. Nos. 3,812,055, 3,895,164, 3,896,046, 3,992,249, 4,313,790, and 4,950,361. In addition, Canadian patents 1,194,254 and 1,150,914 also speak of cationic polymers used for pitch control.

Of the above teachings, none provide the benefits of the synergistic blends found for the instant invention. However, U.S. Pat. No. 4,950,361 speaks of the use of water soluble zirconium compounds to prevent pitch deposition in pulping and papermaking processes, and the two Canadian patents cited above, speak of the use of certain types of cationic polymers for pitch control. However, the teachings of Bender, et. al, U.S. Pat. No. 4,950,361, incorporated herein by reference, teaches the use of zirconium compounds, particularly and most notably ammonium zirconium carbonate, hereinafter referred to as AZC, in the control of pitch and the control of stickies. There is, however, no teachings in the '361 patent about the combined use of zirconium compounds with cationic polymers.

SUMMARY OF THE INVENTION

We have discovered a process for controlling pitch deposition in pulp and papermaking systems, and preventing the deposition of pitch deposits on machinery surfaces in a papermaking process, which comprises adding to a cellulosic pulp, an effective pitch dispersing amount of a combination of a water soluble zirconium compound and a cationic water soluble polymer.

It is preferred in this invention to add these zirconium compounds in solution simultaneously with separate solutions of the cationic polymers. The addition of the water soluble zirconium compounds may be made at any point of the papermaking process, as can the addition of the cationic polymers, as long as they are both simultaneously used prior to sheet formation. Also, water soluble zirconium compounds may be added first, or they may be added after the addition of the cationic polymers. The water soluble zirconium compounds may be added not only in any sequence but in multiple sequences with the cationic polymers, that is, for example, the water soluble zirconium compound may be added first followed the cationic polymer, then followed by the addition of more water soluble zirconium compound. Alternatively, the polymer may be added, followed by zirconium compounds, followed again by cationic polymer, followed again by zirconium compounds, and in similar fashion alternating or non-alternating uses of zirconium compounds with the cationic polymer as the papermaker desires. Preferably, the zirconium and polymer compounds are added simultaneously.

The Water Solubles Zirconium Compounds

Any water soluble zirconium compound may be used. However, it has been found particularly useful to use the ammonium zirconium carbonate compounds as described in U.S. Pat. No. 4,950,361, incorporated herein by reference. These compounds are used in effective dosages to control a formation of pitch deposits and to prevent deposition of pitch on machinery surfaces and in the final paper product. The AZC compounds can be added as ammonium zirconium carbonate solutions at concentrations ranging from about 5 weight percent AZC up to and including about 35 weight percent AZC, or higher. The most effective level of zirconium compound is normally from about 0.003 pounds to about 5.0 pounds of zirconium compound per ton of cellulose slurry. The zirconium compounds must be water soluble and can be chosen from the group consisting of ammonium zirconium carbonate, zirconium acetate, zirconium acetylacetonate, zirconium nitrate, zirconium sulfate, potassium zirconium carbonate, zirconyl chloride, and zirconyl iodide. The zirconium compounds are normally dissolved in water so as to contain from about 5 percent zirconium to about 35 percent zirconium as Zr(IV).

THE CATIONIC WATER-SOLUBLE POLYMERS

By the term cationic water-soluble polymers we mean to include any water-soluble polymer which carries or is capable of carrying a cationic charge when dissolved in water, whether or not that charge-carrying capacity is dependent upon pH. Such polymers include condensation polymers as well as polymers derived from vinyl monomers. As an example of successful use of these cationic polymers, the polymers obtained from the condensation reaction of epichlorohydrin and dimethylamine with and without crosslinkers such as $NH_3$, ethylenediamine, and hexamethylenediamine may be successfully used with the polynuclear aluminum species of this invention. Other condensation polymers such as polymers obtained from the condensation of ethylene dichloride/ammonia, either in the presence or absence of substituted alkyl amines, may also be used effectively with these polynuclear aluminum species.

Vinyl polymers having water solubility and cationic characteristics, as described above, include modified polyacrylamides, modification being made, for example, by the typical Mannich reaction product or the quaternized Mannich reaction products known to the artisan, or other vinylic polymers Vinyl monomers containing functional groups which have cationic character may be used to form, by vinylic or addition polymerization of these types of vinylic cationic polymers, As an example, but not meant to be limiting on this invention, we include in these types of vinyl monomers, such monomers, described in more detail in Table I, as DMAEM, DACHA HCl, DADMAC, DMAEA, MAPTAC, AMPIQ, DEAEA, DEAEM, DMAEAcAm, DMAEMAcAm, DEAEAcAm, DEAEMAcAm, ALA[1] and the quaternized compounds of these monomers. These cationic vinylic monomers may be polymerized as hompolymers, copolymers containing at least one of these cationic vinylic monomers, or copolymers with neutral vinyl monomers, such as acrylamide, methacrylamide, and the acrylic acid esters, and the like.

To be effective, these additive polymers, be they condensation polymers or vinyl addition polymers, must have a To be effective, these additive polymers, be they condensation polymers or vinyl addition polymers, must have a molecular weight of at least 1,000 and may have molecular weights up to, or even exceeding 1,000,000. The preferred condensation polymer is a condensation polymer derived from the reaction of epichlorohydrin and dimethylamine.

TABLE I

| | |
|---|---|
| *[1]DMAEM = | Dimethylaminoethylmethacrylate |
| DACHA HCl = | Diallylcyclohexylamine hydrochloride |
| DADMAC = | Diallyl dimethyl ammonium chloride |
| *DMAEA = | Dimethylaminoethyl acrylate and/or its acid salts |
| MAPTAC = | Methacrylamidopropyl trimethyl ammonium chloride |
| AMPIQ = | 1-acrylamido-4-methyl piperazine (quaternized with MeCl, MeBr, or Dimethyl Sulfate) |
| *DEAEA = | Diethylaminoethyl acrylate and/or its acid salts |
| *DEAEM = | Diethylaminoethyl methacrylate and/or its acid salts |
| *DMAEAcAm = | Dimethylaminoethyl acrylamide and/or its acid salts |
| *DMAEMAcAm = | Dimethylaminoethyl methacrylamide and/or its acid salts |
| *DEAEAcAm = | Diethylaminoethyl acrylamide and/or its acid salts |
| *DEAEMAcAm = | Diethylaminoethyl methacrylamide and/or its acid salts |
| ALA = | allyl amine |

*The quaternary ammonium salt forms are most desirable.

Of the various cationic polymers described above, those polymers prepared by reacting epihalohydrins with certain amines and most preferably epichlorohydrin with dimethyl amine provide a preferred species for use in preparing compositions of the inventions useful in treating paper making systems to aid in pitch control. Specifically, these polyquaternary condensation polymers have essentially linear structure consisting essentially of the difunctional reaction product of a lower dialkylamine and a difunctional epoxy compound selected from the group consisting of epihalohydrins, diepoxides, precursors of epihalohydrins and diepoxides which under alkaline conditions are readily converted into the corresponding epoxy compounds, and mixtures thereof, said polyquaternary polymer containing repeating units of

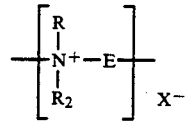

wherein R and $R_2$ are each individually selected from the group consisting of alkyl of 1 to 3 carbon atoms, and E is a residue obtained from said epoxy compound; the total amounts of lower dialkylamine and difunctional epoxy compound reactants being substantially equimolar. The molecular weight may range from at least 1,000 to about 1,000,000, or above. Preferably, the molecular weights are from about 2,000–500,000.

As indicated, preferred condensation polymers of the above type are those prepared by reacting dimethylamine with epichlorylhydrin. The disclosure of the Canadian Patent is incorporated herein by reference as are the teachings of U.S. Pat. No. 3,738,945 which details with great specificity the preparation of the polyquaternary cationic polymers of the type described above and particularly those prepared by reacting dimethlyamine and epichlorylhydrin.

The preferred vinyl cationic polymer are those obtained from DADMAC polymerization. The homopolymers of DADMAC, or the copolymers of DADMAC with at least one of the vinylic monomers chosen from the group consisting of acrylamide, methacrylamides, acrylic acid, methacrylic acid, or (meth) acrylic acid esters or hydroxy esters.

AMOUNT OF CATIONIC POLYMER IN RELATION TO THE POLYALUMINUM CHLORIDE

The cationic polymers and PAC are normally formulated such that the total treating agent contains at least 1.0% by weight of the cationic polymer, based on the weight of polynuclear aluminum chloride solution. Preferably the cationic polymers are present at concentrations between 1.0–10.0 weight percent, based on polynuclear aluminum chloride solution which contains between 5 to 12% PAC as $Al_2O_3$.

DOSAGE AND UTILIZATION OF THE COMPOSITIONS OF THE INVENTION

The compositions of the present invention can be added to the pulp at any stage of the papermaking system. The compositions usually can be added as an aqueous solution. The effective amount of these compositions to be added depends on the severity of the pitch problem which often depends on a number of variables, including the pH of the system, hardness, temperature, and the pitch content of the pulp. Generally between 0.5 ppm and 150 ppm of the composition is added based on the weight of the pulp slurry.

The compositions of the instant invention are effective in controlling pitch deposition in papermaking systems, such as Kraft, acid sulfite, TMP, RMP, CTMP and mechanical pulp (TMP, RMP, CTMP, and GW) papermaking systems. For example, pitch deposition in the brown stock washer, screen room and decker systems in Kraft papermaking processes can be controlled. The term "papermaking system" is meant to include all pulp processes. Generally, it is thought that these compositions can be utilized to prevent pitch deposition on all wetted surfaces from the pulp mill to the reel of the paper machine under a variety of pHs and conditions. More specifically, these compositions effectively decrease the deposition of metal soap and other resinous pitch components not only on metal surfaces, but also on plastic and synthetic surfaces such as machine wires, felts, foils, uhle boxes and headbox components.

The Ratio of Cationic Polymer to Water Solubles Zirconium Compound

The cationic polymers above are ratioed to water soluble zirconium compounds in such a way so as to provide a total treating agent containing at least 1.0 weight percent cationic polymer, based on the rate of zirconium compound, as $ZrO_2$. Preferably, the ratio of water soluble cationic polymers to zirconium compounds ranges from about 5:1 to about 1:5. Most preferably, the cationic polymers are ratioed to the zirconium compounds in the ratio of about 4:1 to about 1:4. Particulary, synergistic results are observed when the cationic polymers, in the form of vinylic polymers of DADMAC are ratioed to zirconium ammonium carbonate in the range of about 3:1 to about 1:3.

Also, particularly synergistic results are observed when condensate polymers, particularly those condensate cationic polymers obtained from epichlorhydrin, dimethylamine, and optionally ammonia, are ratioed to ammonium zirconium carbonate in the weight ratio of approximately 3:1 to 1:3. When these ratios are used in the paper system, they can be added to the pulp at any stage as described above. They can be added at a same stage or different stages as described above, and they may be added alternately or semi-alternately and in single stages or in multiple stages.

Normally, the use of the combined total active ingredients of the sum of the cationic polymer and the sum of the water soluble zirconium compound, as $ZRO_2$, is generally between about 0.5 parts per million and about 150 parts per million of the combination composition, based upon the weight of pulp slurry being treated.

The compositions of this invention are effective in controlling pitch deposition in papermaking systems, such as Kraft mill, both hard and softwoods, acid sulfite processes, TMP, RMP, CTMP and mechanical pulp (TMP, RMP, CTMP, and GW) papermaking systems. Our combination of zirconium compounds and water soluble cationic polymers are useful to control pitch deposition in brown stock washer, the screen room in decker systems and Kraft papermaking processes, and the like. When we use "papermaking systems", it is meant to include all pulp and papermaking processes including, but not limited to those processes mentioned above. These compositions effectively decrease the deposition of metal soaps and other resinous pitch components, not only on metal surfaces, but also on plastic and synthetic surfaces, such as machine wires, felts, foils, uhle boxes, head box components, and the like.

DESCRIPTION OF THE PREFERRED EMBODIMENT

Figure 1:
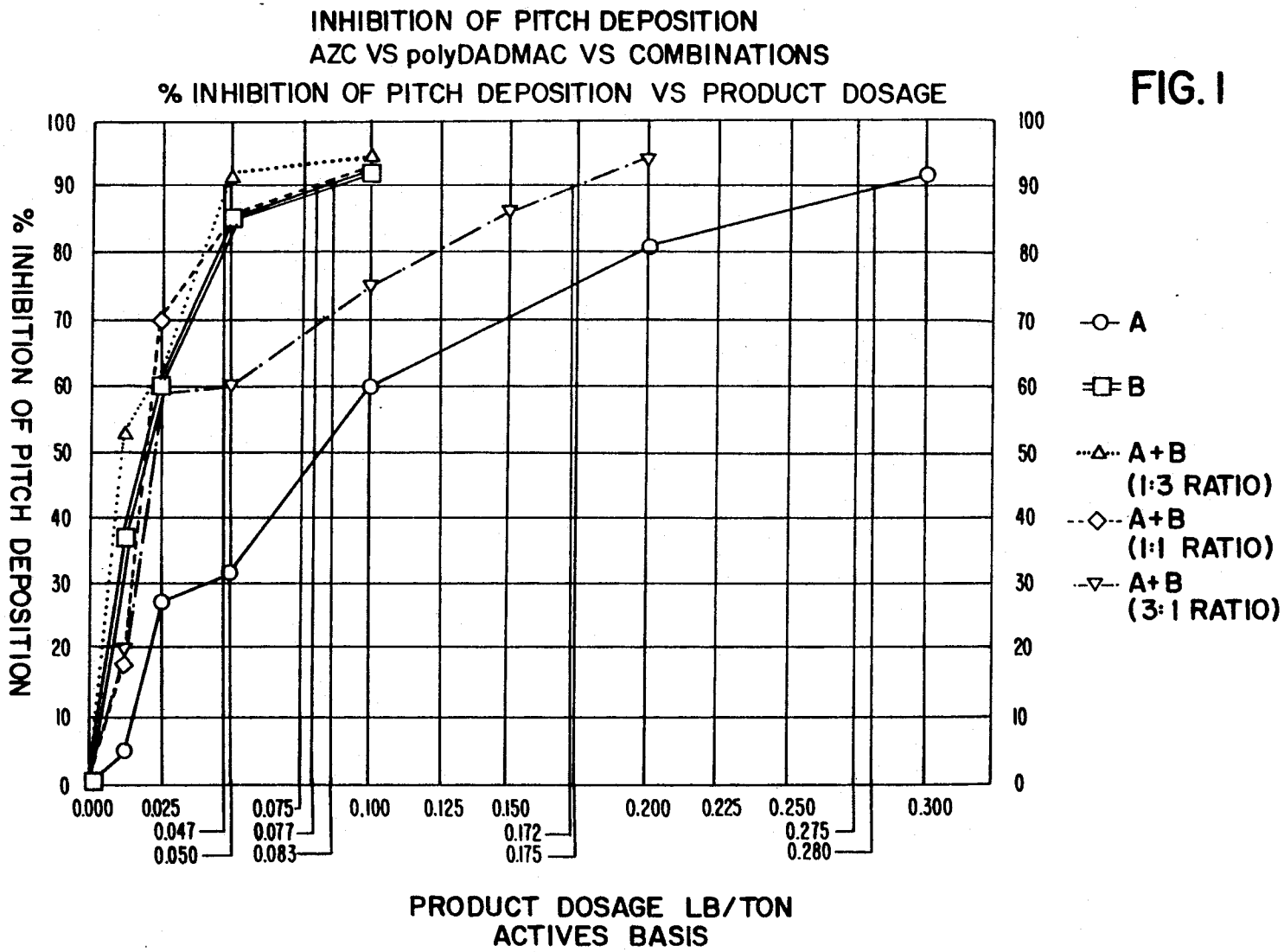
FIG. 1 presents graphical evidence of synergistic results observed when ammonium zirconium carbonate is used with various ratios of a homopolymer of dialyldimethyl ammonium chloride.
Figure 2:
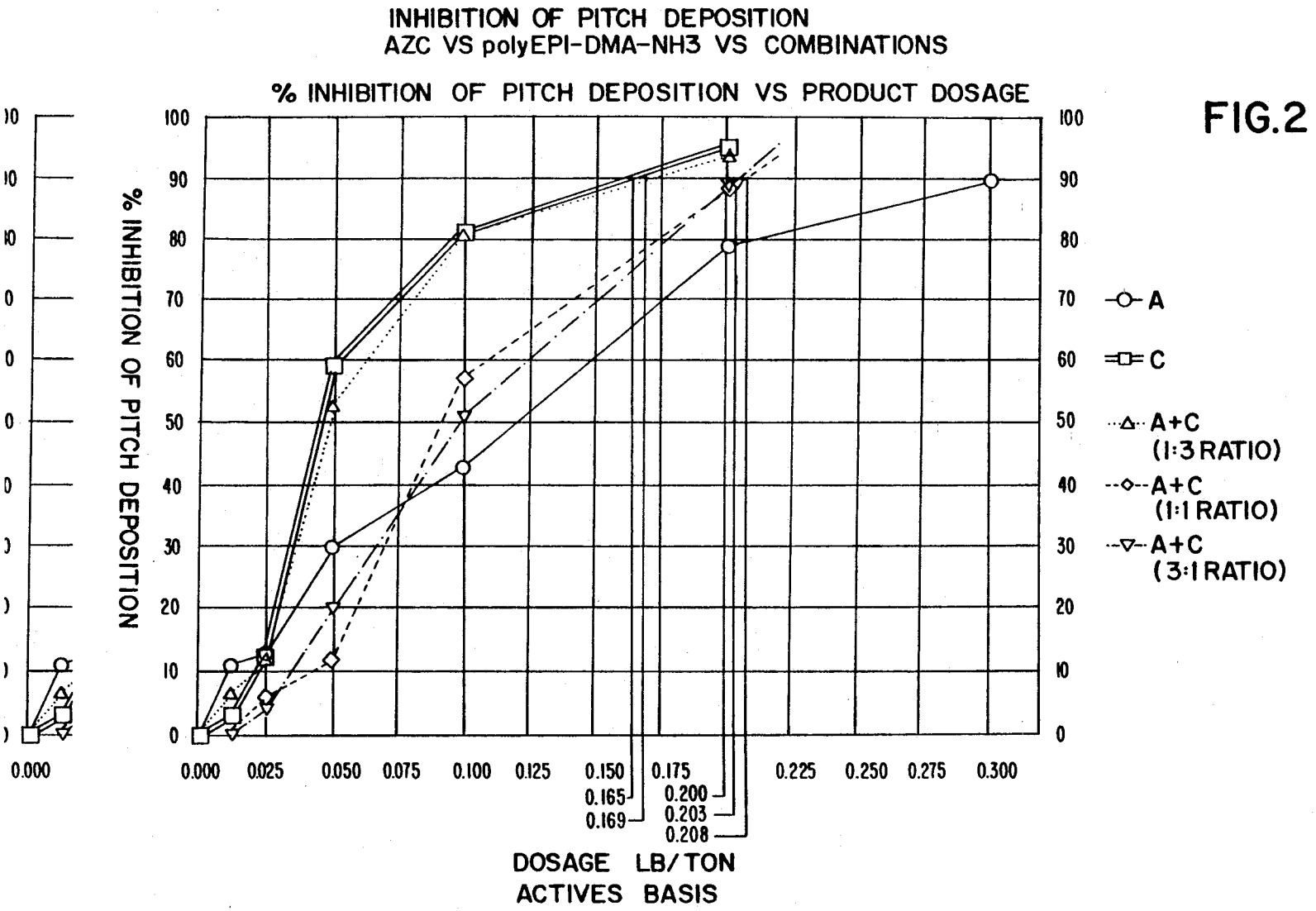
FIG. 2 presents evidence of synergistic results when using combined products containing ammonium zirconium carbonate and a poly epi-dimethylamine, slightly ammonia cross-linked polymer.
Figure 3:
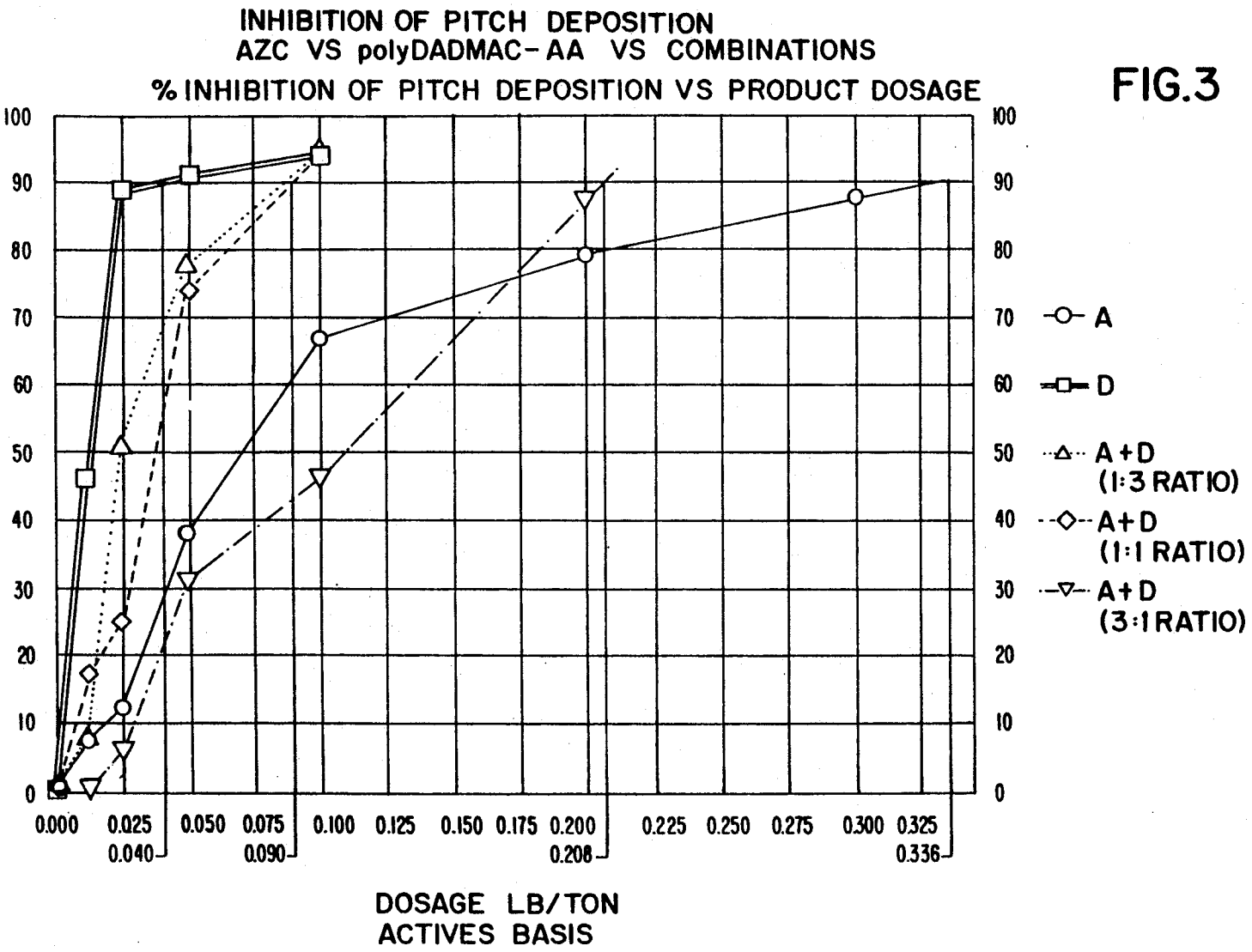
FIG. 3 presents data for synergistic results using ammonium zirconium carbonate and a DADMAC acrylate acid copolymer.

We have invented a process for controlling and preventing pitch deposition on surfaces of machinery, screen, wires, and the like in a papermaking process which comprises adding to a cellulosic slurry contained within the papermaking process an effective pitch dispersing amount of a combination product comprising a water-soluble zirconium compound and a water-soluble cationic polymer.

The preferred weight ratio of water-soluble zirconium compound, as zirconium oxide, $ZrO_2$, to water-soluble cationic polymer ranges from about 4 to 1 to about 1 to 4. Most preferably, these weight ratios range from about 3 to 1 to about 1 to 3 on the basis $ZrO_2$ and the cationic polymer, dry basis.

In our preferred process, the water-soluble zirconium compound is chosen from at least one of the group consisting of ammonium zirconium carbonate, zirconium acetate, zirconium nitrate, zirconium sulfate, and the like. The water-soluble cationic polymer is preferably chosen from at least one of the group consisting of vinylic homopolymers and copolymers of DADMAC and condensation polymers of epichlorohydrin and dimethylamine, optionally cross-linked with small amounts of ammonia.

We have also developed a process for controlling and preventing pitch deposits within a pulp and papermaking process which comprises adding to the cellulosic slurry contained in this process an effective pitch controlling amount of a combination product comprising

| Ingredient | weight percent |
|---|---|
| Ammonium Zirconium Carbonate | 5–35% |
| Poly DADMAC Polymer | 0–35% |
| Poly EPI-DMA-$NH_3$ Polymer | 0–35%, |
| Water | Remainder |

provided that at least one of the polymers must be present at at least 1 weight percent and further provided that the weight ratio of ammonium zirconium carbonate, as $ZrO_2$, to total polymer, dry basis, ranges from about 4.0:1.0 to about 1.0:4.0.

To better describe our process, the following data is presented by example.

EXAMPLES

In Table 1, an experimental procedure for measuring synergistic results of combinations are presented.

TABLE 1

If $\frac{Q_a}{Q_A} + \frac{Q_b}{Q_B} < 1$, then synergy is indicated $> 1$, then antagonism is indicated $= 2$, then additivity is indicated where $Q_A$ = the ppm of actives of Product A alone which produced an endpoint $Q_a$ = the ppm of actives of Product A, in combination which produced an endpoint $Q_B$ = the ppm of actives of Product B alone which produced an endpoint $Q_b$ = the ppm of actives of Product B, in combination which produced an endpoint (taken from U.S. Pat. No. 4,800,235)

In the following tables, the results of testing using ammonium zirconium carbonate in combination with various cationic polymers as described below are presented.

TABLE

| PRODUCT | DESCRIPTION |
|---|---|
| "A"(AZC) | 20%, by weight, as $ZrO_2$pH = 9.0 Ammonium Zirconium Carbonate in $H_2O$ |
| "B"(DADMAC) | 20% active polymer -DADMAC homopolymer M.W. from 50,000–150,000 |

TABLE-continued

| PRODUCT | DESCRIPTION | | |
|---|---|---|---|
| | Property | Spec. Range | Typical Value |
| | *I.V. | 0.5–0.8 dl/g | 0.6 dl/g |
| | pH | 4–5 | 4.5 |
| "C"(Epi-DMA) | 45% polymer in $H_2O$, pH = 3.0–3.5; 1:1 mole ratio of EPI:DMA polymer cross-linked with ammonia. | | |
| | Property | Spec. Range | Typical Value |
| | I.V. | 0.15–0.29 dl/g | 0.18 dl/g |
| | pH | 3–4 | 3.5 |
| "D"(DADMAC-AA) | 90:10 mole ratio DADMAC:Acrylic Acid copolymer | | |
| | Property | Spec. Range | Typical Value |
| | I.V. | 0.89–1.31 dl/g | 0.15 dl/g |
| | pH | 4.5–5.5 | 5 |

*All I.V.'s run in 1M $NaNO_3$ at 30° C.

The following Tables 2–7 present data demonstrating zirconium use in combination with cationic polymers.

TABLE 2

AZC + polyDADMAC
Evaluation of 25:75, 50:50 and 75:25 Combinations for Synergistic Activity

| AZC/poly-DADMAC | Total Actives Level (lb/ton of dry fiber) for 90% Inhibition of Pitch Deposition | $\frac{Q_a + Q_b}{Q_A + Q_B}$ | Ratings |
|---|---|---|---|
| 100/0 | 0.280 | — | — |
| 0/100 | 0.083 | — | — |
| 25/75 | 0.047 (0.012 + 0.035) | 0.456 | synergistic |
| 50/50 | 0.077 (0.0385 + 0.0385) | 0.594 | synergistic |
| 75/25 | 0.172 (0.129 + 0.043) | 0.970 | slightly synergistic or additive |

Calculations:

AZC:polyDADMAC, 25:75 ratio:

$$\frac{0.012}{0.280} + \frac{0.035}{0.083} = 0.465$$

AZC:polyDADMAC, 50:50 ratio:

$$\frac{0.0385}{0.280} + \frac{0.0385}{0.280} = 0.601$$

AZC:polyDADMAC, 75:25 ratio:

$$\frac{0.129}{0.280} + \frac{0.043}{0.083} = 0.979$$

For 90% inhibition, pitch deposit weight = 27.2 mg
Average control (untreated) pitch deposit weight = 272 mg
1 standard deviation = 8.6 mg

TABLE 3

INHIBITION OF PITCH DEPOSITION
AZC VS polyDADMAC VS COMBINATIONS

| PRODUCT | DOSAGE LB/TON ACTIVES BASIS | PITCH DEPOSIT WEIGHT, MG | % INHIBITION OF PITCH DEPOSITION |
|---|---|---|---|
| CONTROL-1 | 0 | 279 | |
| CONTROL-2 | 0 | 261 | |
| A | 0.0125 | 260 | 5 |
| B | 0.0125 | 172 | 37 |
| A:B 1:3 | .003125 + .009375 | 127 | 53 |
| A:B 1:1 | .00625 + .00625 | 224 | 18 |
| A:B 3:1 | .009375 + .003125 | 219 | 20 |
| CONTROL-3 | 0 | 271 | |
| A | 0.025 | 199 | 27 |
| B | 0.025 | 110 | 60 |
| A:B 1:3 | .00625 + .01875 | 100 | 63 |
| A:B 1:1 | .0125 + .0125 | 81 | 70 |
| A:B 3:1 | .01875 + .00625 | 112 | 59 |
| A | 0.05 | 184 | 32 |
| B | 0.05 | 40 | 85 |
| A:B 1:3 | .0125 + .0375 | 21 | 92 |
| A:B 1:1 | .025 + .025 | 38 | 86 |
| A:B 3:1 | .0375 + .0125 | 110 | 60 |
| A | 0.1 | 109 | 60 |

TABLE 3-continued

| PRODUCT | DOSAGE LB/TON ACTIVES BASIS | PITCH DEPOSIT WEIGHT, MG | % INHIBITION OF PITCH DEPOSITION |
|---|---|---|---|
| | INHIBITION OF PITCH DEPOSITION AZC VS polyDADMAC VS COMBINATIONS | | |
| B | 0.1 | 21 | 92 |
| A:B 1:3 | .025 + .075 | 14 | 95 |
| A:B 1:1 | .05 + .05 | 19 | 93 |
| A:B 3:1 | .075 + .025 | 69 | 75 |
| CONTROL-4 | 0 | 284 | |
| A | 0.2 | 51 | 81 |
| A | 0.3 | 21 | 92 |
| A:B 3:1 | .1125 + .0375 | 37 | 86 |
| A:B 1:3 | .05 + .15 | 15 | 94 |
| CONTROL-5 | 0 | 265 | |
| CONTROL-6 | 0 | 274 | |

AVERAGE CONTROL PITCH DEPOSIT WEIGHT = 272 MG
1 STANDARD DEVIATION = 8.6 MG

TABLE 4

AZC + polyEPI/DMA*
Evaluation of 25:75, 50:50 and 75:25 Combinations for Synergistic Activity

| AZC/ p-EPI/DMA* | Total Actives Level (lb/ton of dry fiber) for 90% Inhibition of Pitch Deposition | $\frac{Q_a + Q_b}{Q_A + Q_B}$ | Ratings |
|---|---|---|---|
| 100/0 | 0.300 | — | — |
| 0/100 | 0.165 | — | — |
| 25/75 | 0.169 (0.042 + 0.127) | 0.910 | synergistic |
| 50/50 | 0.208 (0.104 + 0.104) | 0.977 | slightly synergistic or additive |
| 75/25 | 0.203 (0.152 + 0.051) | 0.816 | synergistic |

Calculations:

AZC:polyEPI/DMA, 25:75 ratio:

TABLE 4-continued

AZC + polyEPI/DMA*
Evaluation of 25:75, 50:50 and 75:25 Combinations for Synergistic Activity $$\frac{0.042}{0.300} + \frac{0.127}{0.165} = 0.910$$

AZC:polyEPI/DMA, 50:50 ratio:

$$\frac{0.104}{0.300} + \frac{0.104}{0.165} = 0.977$$

AZC:polyEPI/DMA, 75:25 ratio:

$$\frac{0.152}{0.300} + \frac{0.051}{0.165} = 0.816$$

*polyEPI/DMA = epichlorohydrin/dimethylamine polymer, $NH_3$ crosslinked
For 90% inhibition, pitch deposit weight = 33.3 mg
Average control (untreated) pitch deposit weight = 333 mg
1 standard deviation = 14.7 mg

TABLE 5

| PRODUCT | DOSAGE LB/TON ACTIVES BASIS | PITCH DEPOSIT WEIGHT (MG) | % INHIBITION OF PITCH DEPOSITION |
|---|---|---|---|
| | INHIBITION OF PITCH DEPOSITION AZC VS polyEPI-DMA-NH3 VS COMBINATIONS | | |
| CONTROL-1 | 0 | 345 | |
| CONTROL-2 | 0 | 321 | |
| A | 0.0125 | 295 | 11 |
| C | 0.0125 | 322 | 3 |
| A:C 1:3 | .003125 + .009375 | 310 | 7 |
| A:C 1:1 | .00625 + .00625 | 330 | 1 |
| A:C 3:1 | .009375 + .003125 | 341 | −2 |
| A | 0.025 | 291 | 13 |
| C | 0.025 | 294 | 12 |
| A:C 1:3 | .00625 + .01875 | 297 | 11 |
| A:C 1:1 | .0125 + .0125 | 313 | 6 |
| A:C 3:1 | .01875 + .00625 | 320 | 4 |
| CONTROL-3 | 0 | 341 | |
| A | 0.05 | 233 | 30 |
| C | 0.05 | 138 | 59 |
| A:C 1:3 | .0125 + .0375 | 155 | 53 |
| A:C 1:1 | .025 + .025 | 293 | 12 |
| A:C 3:1 | .0375 + .0125 | 267 | 20 |
| CONTROL-4 | 0 | 325 | |
| A | 0.1 | 190 | 43 |
| C | 0.1 | 62 | 81 |
| A:C 1:3 | .025 + .075 | 64 | 81 |
| A:C 1:1 | .05 + .05 | 143 | 57 |
| A:C 3:1 | .075 + .025 | 163 | 51 |
| A | 0.2 | 71 | 79 |
| C | 0.2 | 17 | 95 |
| A:C 1:3 | .05 + .15 | 19 | 94 |
| A:C 1:1 | .1 + .1 | 39 | 88 |
| A:C 3:1 | .15 + .05 | 38 | 89 |
| CONTROL-5 | 0 | 338 | |
| CONTROL-6 | 0 | 327 | |
| A | 0.3 | 32 | 90 |

AVERAGE CONTROL PITCH DEPOSIT WEIGHT = 333 MG
1 STANDARD DEVIATION = 14.7 MG

TABLE 6

AZC + polyDADMAC/AA*
Evaluation of 25:75, 50:50 and 75:25 Combinations for Synergistic Activity

| AZC/ p-DADMAC/ AA* | Total Actives Level (lb/ton of dry fiber) for 90% Inhibition of Pitch Deposition | $\frac{Q_a + Q_b}{Q_A + Q_B}$ | Ratings |
|---|---|---|---|
| 100/0 | 0.336 | — | — |
| 0/100 | 0.040 | — | — |
| 25/75 | 0.090 (0.022 + 0.068) | 1.765 | antagonistic |
| 50/50 | 0.090 (0.045 + 0.045) | 1.259 | antagonistic |
| 75/25 | 0.208 (0.156 + 0.052) | 1.764 | antagonistic |

Calculations:

AZC:polyDADMAC/AA, 25:75 ratio:

$$\frac{0.022}{0.336} + \frac{0.068}{0.040} = 0.765$$

AZC:polyDADMAC/AA, 50:50 ratio:

$$\frac{0.045}{0.336} + \frac{0.045}{0.040} = 1.259$$

AZC:polyDADMAC/AA, 75:25 ratio:

$$\frac{0.156}{0.336} + \frac{0.052}{0.040} = 1.764$$

*polyDADMAC/AA = DADMAC/acrylic acid copolymer, 90:10 mole ratio
For 90% inhibition, pitch deposit weight = 42.5 mg
Average control (untreated) pitch deposit weight = 425 mg
1 standard deviation = 10.7 mg

TABLE 7

INHIBITION OF PITCH DEPOSITION
AZC VS polyDADMAC-AA VS COMBINATIONS

| PRODUCT | DOSAGE LB/TON ACTIVES BASIS | PITCH DEPOSIT WEIGHT (MG) | % INHIBITION OF PITCH DEPOSITION |
|---|---|---|---|
| CONTROL-1 | 0 | 421 | |
| CONTROL-2 | 0 | 411 | |
| A | 0.0125 | 394 | 7 |
| D | 0.0125 | 229 | 46 |
| A:D 1:3 | .003125 + .009375 | 391 | 8 |
| A:D 1:1 | .00625 + .00625 | 352 | 17 |
| A:D 3:1 | .009375 + .003125 | 425 | 0 |
| CONTROL-3 | 0 | 417 | |
| A | 0.025 | 372 | 12 |
| D | 0.025 | 48 | 89 |
| A:D 1:3 | .00625 + .01875 | 208 | 51 |
| A:D 1:1 | .0125 + .0125 | 317 | 25 |
| A:D 3:1 | .01875 + .00625 | 399 | 6 |
| CONTROL-4 | 0 | 430 | |
| A | 0.05 | 264 | 38 |
| D | 0.05 | 40 | 91 |
| A:D 1:3 | .0125 + .0375 | 92 | 78 |
| A:D 1:1 | .025 + .025 | 110 | 74 |
| A:D 3:1 | .0375 + .0125 | 293 | 31 |
| A | 0.1 | 140 | 67 |
| D | 0.1 | 25 | 94 |
| A:D 1:3 | .025 + .075 | 27 | 94 |
| A:D 1:1 | .05 + .05 | 21 | 95 |
| A:D 3:1 | .075 + .025 | 230 | 46 |
| CONTROL-5 | 0 | 441 | |
| CONTROL-6 | 0 | 429 | |
| A | 0.2 | 79 | 79 |
| A:D 3:1 | .15 + .05 | 54 | 87 |
| A | 0.3 | 54 | 87 |

AVERAGE CONTROL PITCH DEPOSIT WEIGHT = 425 MG
1 STANDARD DEVIATION = 10.7 MG

Having described our invention, we claim:

1. A process for controlling and preventing pitch deposits within a pulp and paper making process which comprises adding to a cellulosic slurry contained in the process an effective pitch controlling amount of a combination product comprising ammonium zirconium carbonate and a homopolymer of DADMAC, having a molecular weight of from 50,000–150,000 within a weight ratio, $ZrO_2$ to polymer, dry basis, of from 3:1 to about 1:3.

2. The process of claim 1 wherein the effective pitch controlling amount of the combination product is such that the ammonium zirconium carbonate present ranges from about 0.003 to about 5.0 pound ammonium zirconium carbonate, as $ZrO_2$, per ton of cellulosic slurry.

3. A process for controlling and preventing pitch deposits within a pulp and paper making process which comprises adding to a cellulosic slurry contained in the process an effective pitch controlling amount of a combination product comprising ammonium zirconium carbonate and a condensation polymer of epichlorohydrin and dimethylamine and ammonia having a molecular weight of from 25,000 to about 250,000 within a weight ration, $ZrO_2$ to polymer, dry basis, of from 3:1 to about 1:3.

4. The process of claim 3 wherein the effective pitch controlling amount of the combination product is such that the ammonium zirconium carbonate present ranges from about 0.003 to about 5.0 pound ammonium zirconium carbonate, as $ZrO_2$, per ton of cellulosic slurry.

* * * * *